US008864422B2

(12) United States Patent
Schwanz

(10) Patent No.: US 8,864,422 B2
(45) Date of Patent: Oct. 21, 2014

(54) METHOD AND ARRANGEMENT FOR PRODUCING A TRENCH WALL ELEMENT

(75) Inventor: Christoph Schwanz, Schrobenhausen (DE)

(73) Assignee: Bauer Spezialtiefbau GmbH, Schrobenhausen (DE)

( * ) Notice: Subject to any disclaimer, the term of this patent is extended or adjusted under 35 U.S.C. 154(b) by 36 days.

(21) Appl. No.: 13/608,972

(22) Filed: Sep. 10, 2012

(65) Prior Publication Data

US 2013/0223939 A1 Aug. 29, 2013

(30) Foreign Application Priority Data

Jan. 31, 2012 (EP) ..... 12000598

(51) Int. Cl.
*E02D 5/18* (2006.01)
*E02D 17/13* (2006.01)

(52) U.S. Cl.
CPC . *E02D 5/18* (2013.01); *E02D 17/13* (2013.01)
USPC ..... 405/267

(58) Field of Classification Search
USPC ..... 405/267; 37/352, 355
See application file for complete search history.

(56) References Cited

U.S. PATENT DOCUMENTS

| | | | |
|---|---|---|---|
| 4,834,197 | A | 5/1989 | Bauer et al. |
| 6,076,290 | A | 6/2000 | Seitle et al. |
| 2006/0032644 | A1 | 2/2006 | Stoetzer |
| 2006/0037218 | A1 | 2/2006 | Stoetzer |

FOREIGN PATENT DOCUMENTS

| | | | |
|---|---|---|---|
| EP | 0 291 027 | A1 | 11/1988 |
| EP | 1 630 301 | A1 | 3/2006 |
| JP | H01-119489 | U | 8/1989 |
| JP | H06-108456 | A | 4/1994 |
| JP | H07-19866 | A | 1/1995 |
| JP | H08-43094 | A | 2/1996 |
| JP | H10-299028 | A | 11/1998 |
| JP | 2002-146829 | A | 5/2002 |
| WO | 90/07098 | A1 | 6/1990 |

OTHER PUBLICATIONS

European Search Report dated Apr. 13, 2012, which corresponds to EP 12 00 0598 and is related to U.S. Appl. No. 13/608,972.

An Office Action; "Notice of Reason for Rejection," issued by the Japanese Patent Office on Jan. 21, 2014, which corresponds to Japanese Patent Application No. 2013-014346 and is related to U.S. Appl. No, 13/608,972; with English language translation.

An Office Action; "Notice of Preliminary Rejection," issued by the Korean Patent Office on Mar. 2, 2014, which corresponds to Korean Patent Application No. Oct. 2013-0010902 and is related to U.S. Appl. No, 13/608,972; with English language translation.

*Primary Examiner* — Tara M. Pinnock
(74) *Attorney, Agent, or Firm* — Studebaker & Brackett PC

(57) ABSTRACT

A method and arrangement for producing a trench wall element in the ground, in which a trench is produced in the ground through removal of ground material by way of a removal device and a hardening medium is introduced into the trench in order to form the trench wall element. Provision is made in that between the removal device and a carrier device at least two ropes are tensioned, for which the respective positions of at least two vertically spaced rope points of a rope are ascertained through angle and distance measurements by way of a measuring device, and in that the ascertained positions of the rope points are used to determine a location of the removal device in the ground.

16 Claims, 3 Drawing Sheets

METHOD AND ARRANGEMENT FOR PRODUCING A TRENCH WALL ELEMENT

Figure 1:
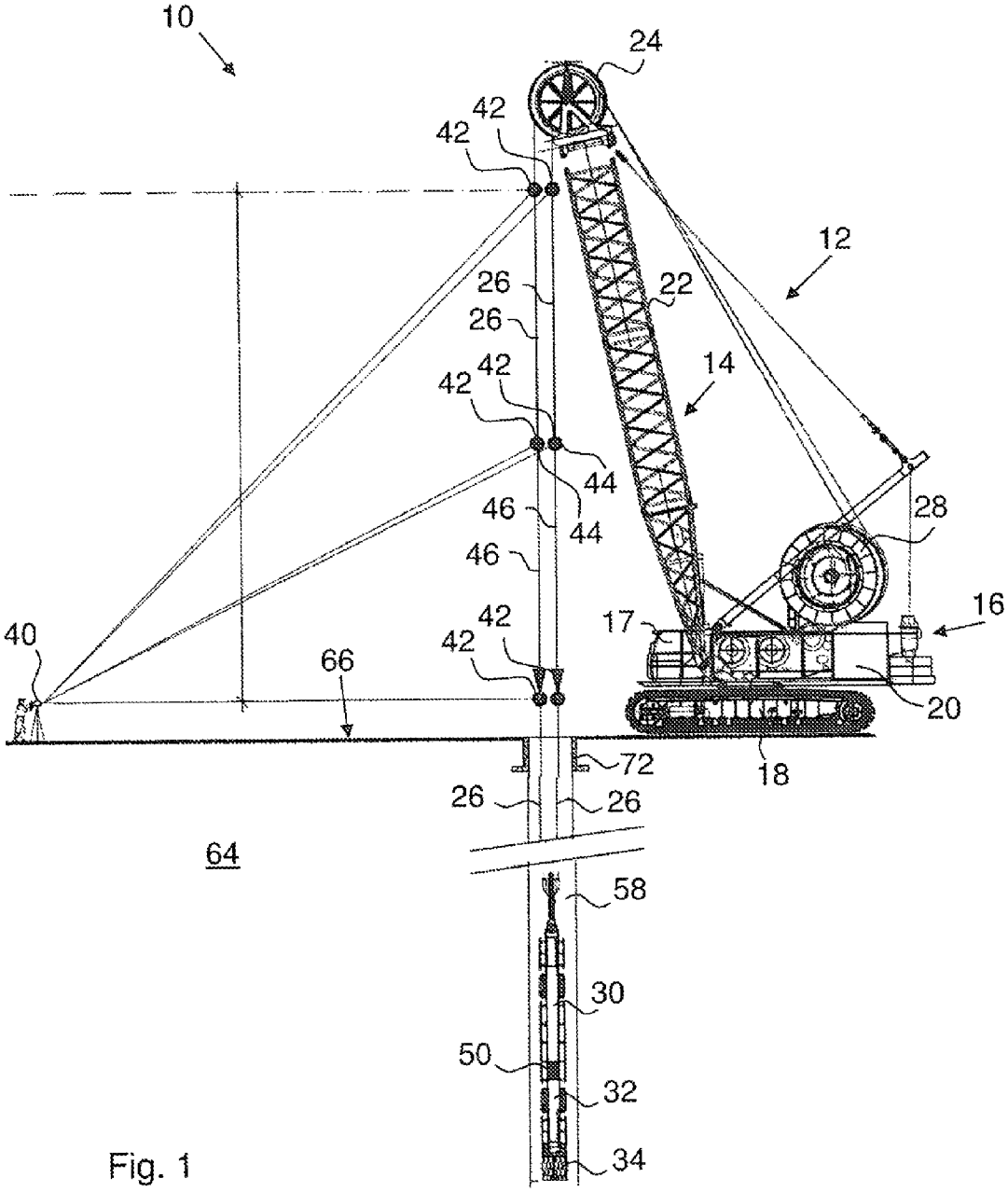

The invention relates to a method for producing a trench wall element in the ground in accordance with the preamble of claim 1. The invention further relates to an arrangement for producing a trench wall element in the ground in accordance with the preamble of claim 13.

In the method according to the invention a trench is produced in the ground through removal of ground material by means of a removal device and a hardening medium is introduced into the trench in order to form the trench wall element.

The arrangement for producing a trench wall element in accordance with the invention comprises a carrier device, a removal device suspended on the carrier device for removing ground material to produce a trench in the ground and an introduction means for introducing a stabilizing medium, in particular a stabilizing suspension, into the trench which is replaced afterwards by a hardening medium, as for example concrete, or it hardens itself.

Especially in the case of trench walls or cut-off walls with great depth it is important to obtain information concerning the location of the trench, in particular its verticality, as early as during the production of the trench. As a rule, trench walls are composed of individual trench wall elements or panels that are arranged next to each other. To avoid leaks between the individual trench wall or cut-off wall panels the individual panels may only deviate marginally from verticality.

In the prior art the following methods for verifying the verticality of trenches are known:

In the case of a so-called Koden-measurement for verifying the verticality and in particular the contour of the trench an ultrasonic measuring device is lowered into a trench filled with a stabilizing suspension. Based on the running times of the sound the ultrasonic measuring device is able to measure the location or the contour of the wall surface of the trench. When carrying out the measurement it is assumed that the ultrasonic measuring device is suspended vertically on a rope in the trench. On the basis of the running time of the sound the distance of the wall to a vertical center line, in which the rope is situated, is determined.

The measurement implemented with a Koden device proves to be very work-intensive and elaborate, since the removal device, for instance a grab or a trench wall cutter, has to be withdrawn completely from the trench before the ultrasonic measuring device can be lowered. Moreover, the ultrasonic measurement only works if the specific weight of the stabilizing fluid is low. If the stabilizing suspension is highly enriched with fine particles, the entire stabilizing fluid has to be exchanged first before the measurement can be carried out.

When measuring with inclinometers, inclination measuring sensors are fixed on the removal device. With the inclination measuring sensors the inclination of the removal device is measured during the sinking process. In this, the measuring accuracy depends on the dynamic loads acting on the removal device. Another drawback resides in the fact that the inclination of the removal device can, in fact, be determined but not, however, a lateral drifting of the removal device during the removal of ground material. Such a lateral drifting occurring during the removal process cannot be detected by a driver of the device.

To measure the course of the trench in the vertical direction it is possible to carry out separate measuring runs with the removal device. In these measuring runs a traverse line is ascertained which runs in each case from the upper edge of the trench to the depth location reached. However, these separate measuring runs are time-consuming and expensive.

A drawback of both measuring methods resides in the fact that only individual trench wall panels can be measured at a time but not, however, a connection of two panels lying next to each other. The assessment of individual joints between the trench wall panels remains uncertain, since a spatial connection and a comparison of several measurements cannot be implemented at all or only with a considerable additional amount of work involved in calibrating the guide wall and the position of the device.

The invention is based on the object to provide a method and an arrangement for producing a trench wall element in the ground, which allow for a precise and economical production of a trench wall.

In accordance with the invention the object is solved by a method having the features of claim 1 and by an arrangement having the features of claim 13. Preferred embodiments of the invention are stated in the respective dependent claims.

The method according to the invention is characterized in that between the removal device and a carrier device at least two ropes are tensioned, for which the respective positions of at least two vertically spaced rope points of a rope are ascertained through angle and distance measurements by means of a measuring device, and in that the ascertained positions of the rope points are used to determine a location of the removal device in the ground.

The arrangement according to the invention is characterized in that between the removal device and the carrier device at least two ropes are tensioned, in that a measuring device is provided, through which the respective positions of at least two vertically spaced rope points can be ascertained by means of angle and distance measurements for the at least two ropes and in that an evaluation means is provided, with which a location of the removal device in the ground can be determined by making use of the data of the measuring device.

A first fundamental idea of the invention can be regarded in the fact that between the removal device, as for example a trench wall cutter or a trench wall grab, and the carrier device, for instance a carrier vehicle for the removal device, at least two ropes are tensioned, whose respective alignment in space is ascertained in order to determine the location of both the removal device and the trench in the ground. For this purpose, the spatial position of at least two rope points is ascertained for each rope in accordance with the invention. Basically, these rope points can be selected freely. Between the mutually spaced rope points a mathematical vector is spanned, the alignment of which is used to determine the location of the removal device. Due to the fact that the ropes are tensioned between the removal device and the carrier device it can be assumed that the ropes run along a straight line so that linkage points of the ropes on the removal device are each situated in the extension of the vectors spanned by the rope points.

Providing that the ropes run in a straight line, by way of the direction of extension of the ropes as well as the location of a rope point with respect to a given reference point, the location of the removal device can be deduced. This refers, in particular, to the linkage points or suspension points of the ropes on the removal device. The method according to the invention and the arrangement according to the invention permit, in particular, the detection of a lateral drifting of the removal device.

A second fundamental idea of the invention resides in the fact that use is made of several ropes, in particular at least two ropes which make it possible to determine the alignment of the removal device in space, hence the three-dimensional location of the removal device. In particular, a lateral tilting of the removal device, i.e. a deviation from the vertical, and torsion, i.e. a twist about the vertical, can be ascertained. By determining the spatial location of the removal device at different points in time it is possible to ascertain the shape and location of the trench.

Basically, separate measuring ropes can be employed as ropes. By preference, however, at least one of the ropes is a support rope on which the removal device is suspended. It is especially advantageous if both ropes are support ropes. In this way, the support rope or ropes of the removal device can be used at the same time for determining the location of the removal device so that no separate measuring ropes are required. The use of the support ropes as measuring ropes also has the advantage that, given the weight of the removal device, it can be assumed that the ropes are tensioned in a straight line unless the removal device rests on the bottom of the trench with slack ropes.

In a preferred embodiment of the method provision is made for a depth location of the removal device in the ground to be ascertained and used to determine the location of the removal device. The depth location can be determined for example by way of a measurement means arranged on the removal device or via the unwound length of the support rope or ropes on which the removal device is suspended. From the data of the rope points or rather the vector ascertained therefrom and the data concerning the depth location of the removal device a precise spatial location of the removal device as well as the shape and location of the trench can be calculated at any time.

To increase the measuring accuracy it is preferred that the removal process is interrupted prior to ascertaining the positions of the rope points in order to steady the removal device and the ropes.

Moreover, the measuring accuracy can be improved in that the ropes are specifically tensioned before ascertaining the positions of the rope points. To this end provision is made, in particular, for the removal device to be pulled up slightly, i.e. to be lifted from the bottom surface of the trench where necessary, so that the ropes, more particularly the support ropes, are pulled taut. When using separate measuring ropes a rope tensioning means can be provided. This results in a straight line between the suspension point of the ropes on the removal device and a linkage point on the carrier device, which can be a deflection roller in particular.

The measurement of the at least four measuring points can be carried out relatively quickly so that the production process is only interrupted for a short time. In this connection it is especially advantageous that the removal device can remain in the trench during the measurements.

In another preferred embodiment of the invention more than two ropes are provided, on which the respective positions of at least two rope points are determined. As a result, the measuring accuracy can be increased further and/or a check measurement can be carried out.

Furthermore, the reliability of determining the location of the removal device can be enhanced in that between two rope points of a rope the position of at least one third rope point is determined as a measurement checkpoint. If it turns out that the two measuring points for calculating the vector and the measurement checkpoint lie on a straight line, one can assume that the rope is straight-lined over its entire length.

In an advantageous embodiment of the invention the measuring device is arranged on or above the ground surface with unobstructed view of the ropes. The measuring device locates the ropes and, by making use of at least two measured values per rope, ascertains the location of the rope in space. The two measuring points are situated at different heights above the ground surface.

To achieve the highest possible accuracy one of the at least two measuring points is arranged as far down as possible while the other is arranged as high up as possible. A lower measuring point is to be understood, in particular, as a measuring point arranged close to the ground surface and an upper measuring point is to be understood as a measuring point arranged e.g. close to a mast-top of the carrier device.

According to the invention it is preferred that for angle and distance measurement a measuring device is used which permits angle measurements in the vertical and horizontal direction and, in addition, the measurement of a distance. By preference, a tachymeter is used as a measuring device. The ropes are sighted optically by the tachymeter.

To determine the position of the located rope point the measuring device emits an electromagnetic beam, for example a light beam, which is reflected by the located rope point. Basically, the rope point can be any chosen point on the rope. A measurement is undertaken of the distance of the rope point to the measuring device, for example by means of running time measurement or phase shift. Furthermore, the angle of the light beam directed onto the rope point is determined in relation to a given reference axis. With the distance and angle measurement thus carried out the position of the located rope point can be determined in space. The ascertainment of the position of the further rope points is effected in the same manner.

The light beam preferably is light in the infrared range and by preference a laser beam. To locate the rope points e.g. the center of the rope can be sighted using for example the crosshairs of the tachymeter. By preference, the sighting is not effected until the ropes are steadied, i.e. preferably when the ropes are at a standstill.

According to the invention it is preferred that a position of the measuring device and/or of the removal device is determined in relation to a construction site coordinate system. If, for instance, the position or place of the measuring device in relation to the construction site coordinate system is known, it is also possible to determine therefrom the position of the removal device in relation to the construction site coordinate system. This allows for an economical and quick production of a trench wall element with a given contour and location at a predetermined position in relation to the construction site coordinate system.

In addition, it is preferred that by means of an inclinometer an inclination of the removal device to the vertical is measured. The inclinometer is preferably arranged on or in the removal device. If the spatial location of the linkage points of the ropes on the removal device is known, it is possible, through addition of a further vector indicating the inclination and length of the removal device, to figure out the location of the contact area of the removal device and the spatial location of the removal device in the ground. The length of this inclination vector corresponds to the length of the removal device from the linkage point of a rope to the contact area. The measurement result of the inclinometer is transmitted for example via cable to the driver's cab or to an evaluation means or a control computer.

By preference, the inclination of the removal device is measured continuously during sinking in order to detect a deviation from the vertical in good time and ensure the production of a vertical trench through a correction of location.

The production of the trench wall element is furthermore facilitated in that by means of an evaluation means the location of the removal device is indicated and/or an instruction for a correction of location is given by making use of the data of the measuring device and, if required, of the inclinometer. For example the location of the removal device in the trench or in the ground can be indicated on an indication means to an operator of an arrangement according to the invention. If required, the operator can then carry out a correction of location. It is especially advantageous if the evaluation means, based on the ascertained current location of the removal device, provides the driver with measures for correcting the location. For example a value of an adjusting mechanism for a correction of location, e.g. of a control flap of the removal device, can be indicated which can be set.

The trench can be produced in a particularly convenient manner if the location of the removal device is controlled automatically with a control means by making use of the data of the measuring device and, where required, of the inclinometer. A computer or data processor can bring about e.g. a direct control of the removal device without human intervention.

By preference, the data of the measuring device, especially the measurement data of the rope points or data based thereon, are transmitted via cable or radio to the evaluation means and/or the control means. In particular, a transmission of the data can be effected into a driver's cab of the carrier device.

The sighting of the measuring points by the measuring device can be implemented, for example, by a ground surveyor who operates the measuring device. However, it is also possible that the measuring device sights the measuring points independently. This can take place, for example, through the use of lasers which bring about a control of the measuring device. Especially with regard to an independent control of the measuring device it is of advantage if both a vertical and a horizontal axis of rotation of the measuring device are motor-driven.

An automatic sighting of the measuring points can also be brought about in that sighting elements, such as mirrors, reflectors or films, are provided on the ropes at given positions. The sighting elements can be fixed temporarily on the ropes. They can facilitate sighting by the measuring device.

Basically, it is also possible to arrange signal-emitting elements at defined positions on the ropes, which can be localized by a receiver in the measuring device. By way of localization the measuring device can be aligned automatically to the measuring points. Such a signal-emitting element could be an ultrasonic or radio transmitter for example.

With regard to the arrangement for producing the trench wall element it is preferred that the measuring device is arranged in a spaced manner from the carrier device. In particular, the measuring device can be arranged as a separate device next to the carrier device, in particular being arranged several meters away from the carrier device. In this connection provision is made, in particular, for the measuring device to be mechanically decoupled from the carrier device so that movements of the carrier device are not transmitted to the measuring device. For example the measuring device is set up at a distance to the carrier device on the ground surface. Basically, however, it is also conceivable that the measuring device is fixed on the carrier device, as for example on the mast.

By preference, an indication means is provided which indicates the location of the removal device by making use of the data of the measuring device. The indication means can have a display monitor, for example, which can be arranged e.g. in a driver's cab of the carrier device. The measured values of the measuring device or respectively the location of the removal device can be indicated in a graphic representation for example. By preference, a deviation from a theoretical vertical line, torsion and/or drifting of the removal device is indicated. The driver of the carrier device can then influence the location of the removal device for example by means of control flaps situated on the removal device.

An especially precise and quick trench wall production can be achieved in that a control means is provided for automatically controlling the removal device by making use of the data of the measuring device.

Figure 2:
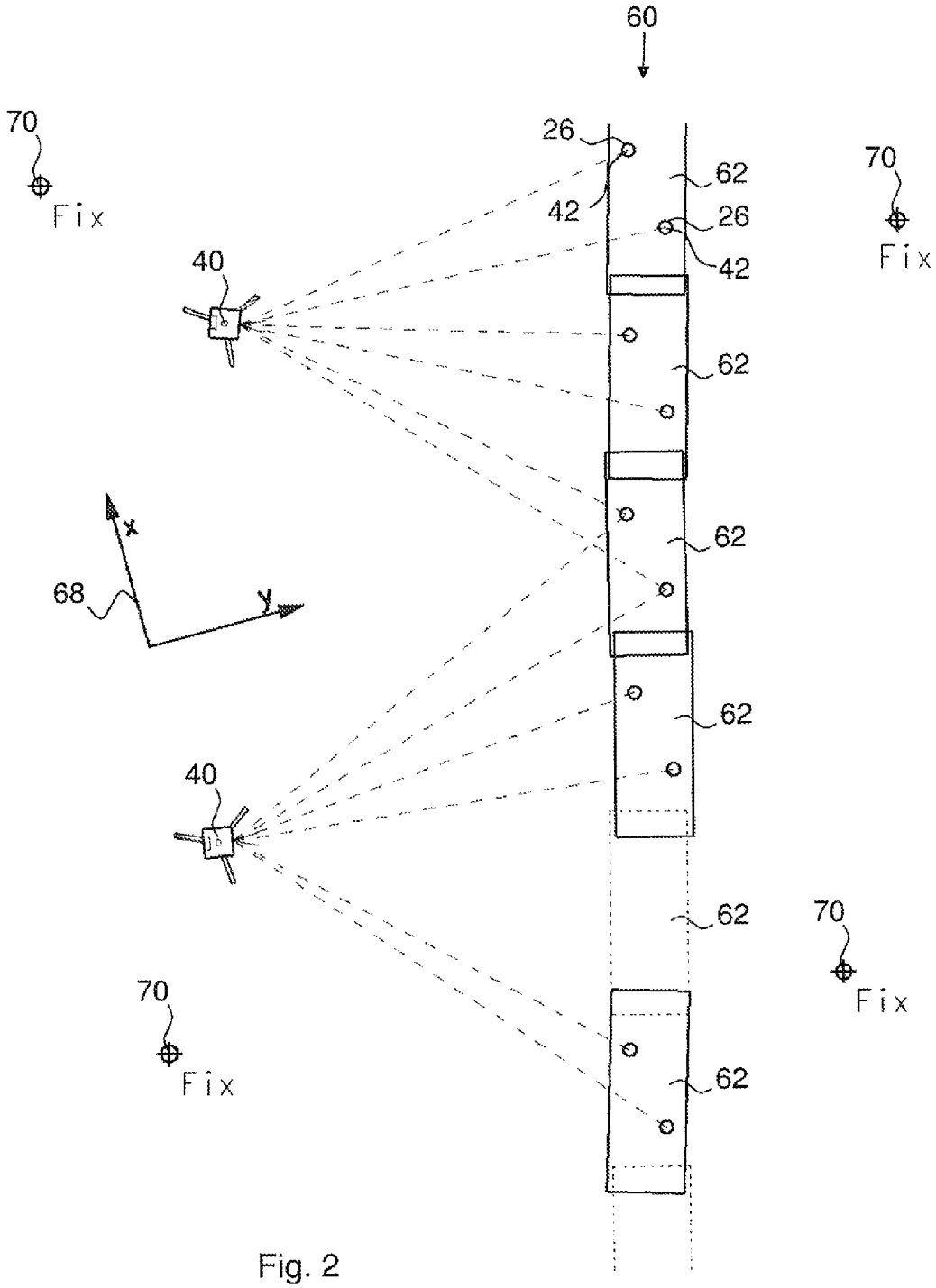
Figure 3:
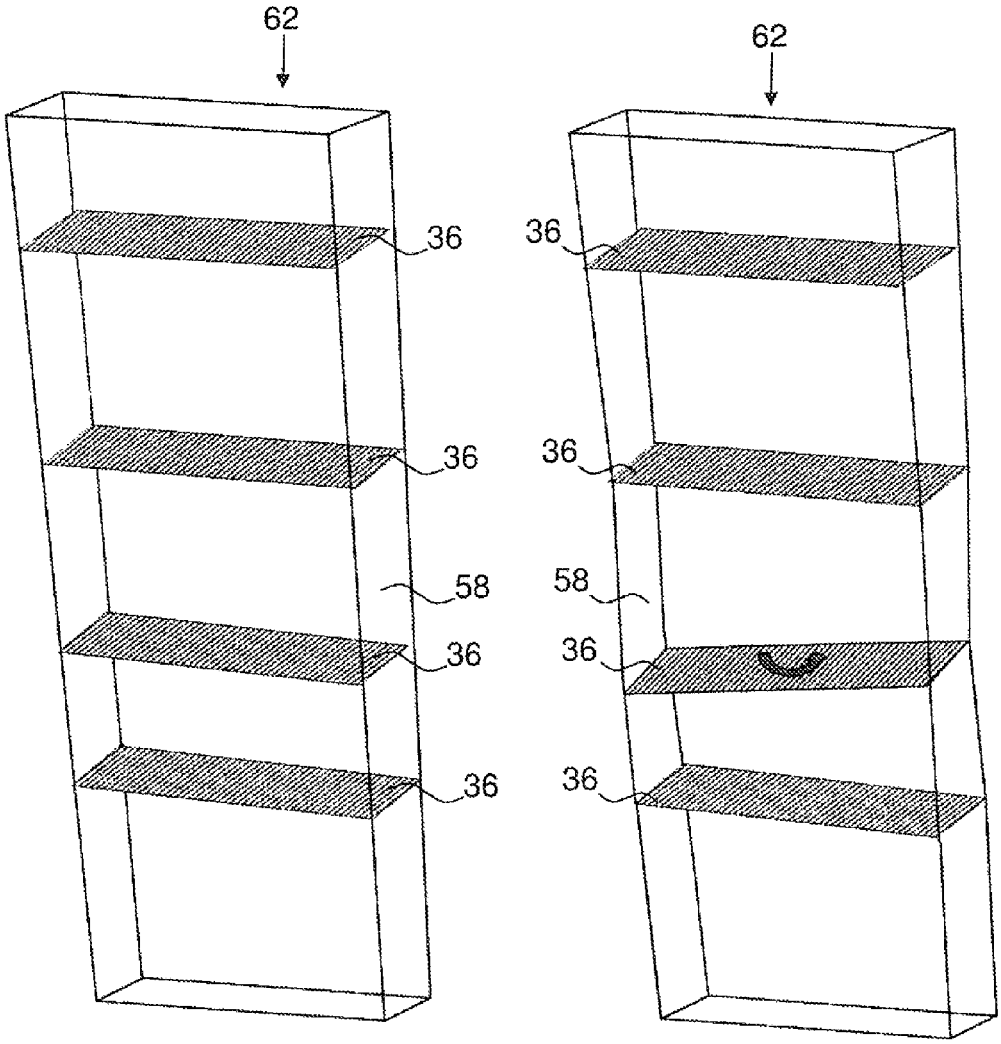

In the following the invention will be described further by way of preferred embodiments which are illustrated schematically in the accompanying drawings, wherein show:

FIG. 1 an arrangement for producing a trench wall element or a trench wall;

FIG. 2 a schematic illustration of the production of a trench wall consisting of several trench wall elements and FIG. 3 two trench wall elements with schematically indicated locations of the removal device during their production.

Elements corresponding to each other are designated in all Figures with the same reference signs.

An arrangement 10 according to the invention for producing a trench wall element 62 is shown in FIG. 1. The arrangement comprises a construction device 12, more particularly a device for producing a trench wall. The construction device 12 has a carrier device 14, on which a removal device 30, as for example a trench wall cutter or a trench wall grab, is suspended via two ropes 26 in the form of support ropes. On a carrier vehicle 16, which has an undercarriage 18 and an upper carriage 20 supported thereon in a rotatable manner about a vertical pivot axis, a mast 22 is supported. The support ropes are guided via a deflection roller 24 arranged in the upper area of the mast 22 and can be wound up or unwound via a winch 28.

The removal device 30, which is suspended on the support ropes and can also be referred to as an excavation device, comprises in the illustrated embodiment a frame 32, which can be lowered into a trench 58 in the ground 64 and at the lower end of which at least one removal tool, in particular a cutting wheel 34 is arranged. The cutting wheel 34 is supported in a rotatable manner on the frame 32 for the purpose of removing ground material.

For the production of a cut-off wall or trench wall element 62 a trench 58 is initially produced in the ground 64 using the removal device 30. In this process, the removal device 30 is lowered in a substantially vertical manner and through the removal or excavation of ground material it produces the trench 58. During or after its production the trench is filled with a hardening medium, in particular a hardening suspension, concrete or soil-concrete, which hardens to form the cut-off wall or trench wall element 62.

The production of a cut-off wall or trench wall 60 consisting of a plurality of cut-off wall or trench wall elements 62 is depicted schematically in FIG. 2. To produce the trench wall 60 individual trench wall elements 62 are produced step-by-step which overlap in each case, as shown in FIG. 2.

To prevent spaces from developing in-between the individual trench wall elements 62 of the trench wall 60 and to ensure tightness of the trench wall 60 the individual trench wall elements 62 have to be aligned precisely. In particular, tilting, drifting and torsion of the trench wall elements 62 must be avoided.

By filling the produced trenches 58 with the material that hardens to form the respective trench wall element 62 the shape of the produced trenches 58 corresponds to the individual trench wall elements 62 or the trench wall 60. The location of the individual trenches 58 is in turn determined by the location of the removal device 30. Thus, by knowing and possibly correcting the location of the removal device 30 the location of the trench wall elements 62 to be produced can be determined.

To ascertain the location of the removal device 30, which can also be understood, in particular, as the spatial alignment, a measuring device 40 is provided in accordance with the invention. The measuring device 40 is a tachymeter, in particular, which can be operated by a ground surveyor and is set up above a ground surface 66. By means of the tachymeter rope points 42 can be sighted in particular optically and their spatial location can be determined as a measured value. The measuring or rope points 42 are situated above the ground surface 66 or outside the trench 58.

By determining the spatial location of at least two measuring or rope points 42 on the rope 26 a vector 46 of the respective rope 26 can be calculated, in the extension of which a linkage point of the rope 26 on the removal device 30 is situated. Through a corresponding measurement carried out on a second rope 26 a second linkage point on the removal device 30 can be determined. Being aware of the at least two linkage points it is then possible to ascertain the spatial location or alignment of the removal device 30 in the ground 64.

Due to its high weight the removal device 30 is normally suspended perpendicularly on the linkage points of the ropes 26. In this way, conclusions can be drawn as to the location of the removal device 30 at its contact area if the length of the removal device 30 is added to the measurement results.

To increase the measuring accuracy an inclinometer can be provided on or in the removal device 30. This inclinometer can serve the driver as a control during the vertical sinking of the removal device 30. If the inclinometer 50 shows an angle of the removal device 30 that deviates from the perpendicular, it is possible, for the purpose of determining the location and alignment of the contact area of the removal device 30, that an inclined vector, whose length corresponds to the length of the removal device 30, is added to the ascertained linkage points of the ropes on the removal device 30.

In particular, the production of a trench wall element 62 comprises the following method steps:

1. Positioning of the measuring device 40 for determining angles and distances within the range of sight of the ropes 26 of the device 10,
2. Sinking the removal device 30 up to a given depth,
3. Stopping the removal process,
4. Tensioning the support ropes of the removal device 30,
5. Ascertaining the depth location of the removal device 30, for instance of a fastening point of the support ropes on the removal device 30 or a lower endpoint of the removal device 30,
6. Measuring at least two rope points 42 per rope 26 with the measuring device 40,
7. Optional determining of an inclination or slanted position of the removal device,
8. Passing the measurement data of 6. or, as the case may be, of 7. to an evaluation means, as for example a data processor or computer. The evaluation means can be situated for example in the measuring device 40 or on the carrier device 14. The unprocessed data or raw measurement data or, as the case may be, the processed data can be transmitted to the carrier device.

When producing the trench wall 60 the measuring device can remain stationary during the production of a predetermined number of trench wall elements, while the device 10 is moved step-by-step in order to produce further trench wall elements 62.

For measurement checking at least one further measuring point 42 can be determined as a measurement checkpoint 44 between two measuring or rope points 42 of a rope 26 that serve as calculation values for determining the vector 46. If all measuring points 42 of a rope lie on a straight line, it can be assumed that the rope 26 runs all in all in a straight manner.

On the construction site a fixed construction site coordinate system 68 is installed. By preference, the position of the measuring device 40 in relation to the construction site coordinate system 68 is known. The construction site coordinate system 68 has several fixed points 70 as reference points for example. By preference, the rope or measuring points 42 on the ropes 26 can also be ascertained in relation to the construction site coordinate system 68. Through this, it is also possible to calculate the spatial position of the removal device 30 in relation to the construction site coordinate system 68.

FIG. 3 shows in a schematic fashion different cross-sectional planes 36 of a removal device 30, which illustrate the location of the removal device 30 in different depths in the trench 58 or alternatively of the resultant trench wall element 62. In the illustration on the left side an ideal guidance of the removal device 30 is shown, in which the individual cross-sectional planes 36 are arranged in a substantially parallel and vertical manner one below the other. In the illustration on the right side one of the cross-sectional planes 36 is tilted. In this area the trench 58 shows an undesired location which might lead to leaks in the trench wall 60. Such undesired deviations of individual trench wall elements 62 can be avoided reliably and at low cost with the present invention.

The location of the removal device 30 in the trench can be indicated to the operator of the construction device in a driver's cab on a display 17. For example an absolute location of the removal device 30 in the trench 58 can be represented with respect to a zero line of verticality.

To introduce the removal device 30 into the ground 64 a guide wall or drilling template 72 can be provided at a given position in an upper area of the ground 64.

The invention claimed is:

1. A method for producing a trench wall element in the ground, in which a trench is produced in the ground through removal of ground material by means of a removal device and a hardening medium is introduced into the trench in order to form the trench wall element, wherein between the removal device and a carrier device at least two ropes are tensioned, for which the respective positions of at least two vertically spaced rope points of a rope are ascertained through angle and distance measurements by means of a measuring device, and in that the ascertained positions of the rope points are used to determine a location of the removal device in the ground.

2. The method according to claim 1, wherein at least one of the ropes is a support rope, on which the removal device is suspended.

3. The method according to claim 1, wherein a depth location of the removal device in the ground is ascertained and used to determine the location of the removal device.

4. The method according claim 1, wherein the removal process is interrupted prior to ascertaining the positions of the rope points.

5. The method according to claim 1, wherein the ropes are tensioned prior to ascertaining the positions of the rope points.

6. The method according to claim 1, wherein more than two ropes are provided, on which the respective positions of at least two rope points are determined.

7. The method according to claim 1, wherein between two rope points the position of at least one third rope point is determined as a measurement checkpoint.

8. The method according to claim 1, wherein for angle and distance measurement a tachymeter is used as a measuring device.

9. The method according to claim 1, wherein a position of the measuring device and/or of the removal device is determined in relation to a construction site coordinate system.

10. The method according to claim 1, wherein by means of an inclinometer an inclination of the removal device to the vertical is measured.

11. The method according to claim 1, wherein by means of an evaluation means the location of the removal device is indicated and/or an instruction for a correction of location is given by making use of the data of the measuring device.

12. The method according to claim 1, wherein the location of the removal device is controlled automatically with a control means by making use of the data of the measuring device.

13. An arrangement for producing a trench wall element in the ground with a carrier device, a removal device suspended on the carrier device for removing ground material to produce a trench in the ground and an introduction means for introducing a stabilizing medium into the trench, wherein between the removal device and the carrier device at least two ropes are tensioned, a measuring device is provided, through which the respective positions of at least two vertically spaced rope points can be ascertained by means of angle and distance measurements for the at least two ropes, and in that an evaluation means is provided, with which a location of the removal device in the ground can be determined by making use of the data of the measuring device.

14. The arrangement according to claim 13, wherein the measuring device is arranged in a spaced manner from the carrier device.

15. The arrangement according to claim 13, wherein an indication means is provided which indicates the location of the removal device by making use of the data of the measuring device.

16. The arrangement according to claim 13, wherein a control means is provided for automatically controlling the removal device by making use of the data of the measuring device.

* * * * *